US008353078B2

(12) United States Patent
Bailey, Jr.

(10) Patent No.: US 8,353,078 B2
(45) Date of Patent: Jan. 15, 2013

(54) ANCHOR AND ALIGNMENT DEVICE FOR CARPET TILES

(75) Inventor: Wilson Edward Bailey, Jr., Forest Hill, MD (US)

(73) Assignee: CarptetLOK, LLC, Forest Hill, MD (US)

( * ) Notice: Subject to any disclaimer, the term of this patent is extended or adjusted under 35 U.S.C. 154(b) by 294 days.

(21) Appl. No.: 12/731,034

(22) Filed: Mar. 24, 2010

(65) Prior Publication Data

US 2011/0005031 A1 Jan. 13, 2011

(51) Int. Cl.
*A47G 27/04* (2006.01)

(52) U.S. Cl. ..... 16/4

(58) Field of Classification Search ..... 16/4–17.1; 24/690; 411/921, 457; 428/44–52, 99–100
See application file for complete search history.

(56) References Cited

U.S. PATENT DOCUMENTS 677,725 A * 7/1901 Weeks ..... 16/17.1
2,236,465 A * 3/1941 Carlson ..... 52/179
4,086,679 A 5/1978 Butler
4,837,889 A 6/1989 Saotome
5,288,534 A 2/1994 Tavshanjian
5,359,783 A 11/1994 Smith
5,958,540 A * 9/1999 Berard et al. ..... 428/48
6,216,315 B1 * 4/2001 Fuzzell ..... 16/17.1
6,612,045 B2 9/2003 Kruskamp
6,708,367 B2 * 3/2004 Billson ..... 16/16
7,536,802 B1 5/2009 Tavy et al.

* cited by examiner

*Primary Examiner* — Victor Batson
*Assistant Examiner* — Matthew Sullivan
(74) *Attorney, Agent, or Firm* — Louis Ventre, Jr.

(57) ABSTRACT

An anchor for a carpet tile includes a cross-shaped base having four arms extending from a vertex. The arms form a planar top surface and a planar bottom surface. A vertical blade centered on the base rises to engage the backing of a carpet tile when a corner of the carpet tile is placed near the vertex. The blade is preferably made of bendable and resilient material. Preferably, the anchor is used with a pedestal head of a raised-flooring system and has a nub extending from the bottom surface of each of the arms of the base to fit within holes in the pedestal head and thereby secure the anchor to the pedestal head. An alternative anchor includes a plate for the base and the blade in the shape of a cross rises from the plate. The plate may have a hole in each quadrant defined by the blade.

9 Claims, 3 Drawing Sheets

ANCHOR AND ALIGNMENT DEVICE FOR CARPET TILES

TECHNICAL FIELD

In the field of carpet fasteners, a fastening device for securing and aligning carpet tiles in extended position upon floor-coverings.

BACKGROUND ART

The invention has primary application to raised floor systems using carpet tiles as a finished surface. Raised flooring, also called access flooring, is commonly found in commercial building over a cement slab.

Raised flooring systems usually include rectangular access floor panels made of metal. The access floor panels are reinforced or consist of metal covered composition wood cores. The panels are typically 2 feet by 2 feet steel or aluminum panels. The space below the panels is typically used for air flow, power, or voice and data cable trays.

The access floor panels may be installed in a gridless system or grid system. These systems vary in raised flooring system support, that is, the means of support for the access floor panels.

In gridless systems, pedestal heads are positioned beneath the corners of four abutting panels so that each access floor panel is supported by a pedestal at one of its corners. Each pedestal is typically capable of height adjustment. The top of the pedestal where the access floor panels are attached is called the pedestal head. Each access floor panel spans four pedestals and is usually screwed to the pedestals at each corner. Thus, in a typical raised-flooring installation in a gridless system, pedestals are attached to the cement slab to provide an elevated, fixed support for access floor panels laid atop the pedestals.

A grid system delivers increased stability and load capacity by connecting the pedestal heads using stringers, which are attached perpendicularly to the pedestal heads and arranged horizontally, that is, parallel to the subfloor. The grid system is configured when each stringer is registered with and positioned beneath an edge of a rectangular panel. The grid system provides the requisite additional support for each access floor panel along its entire periphery, rather than just at its corner.

Each carpet tile typically has the same dimensions as the access floor panel on which it is laid, which is usually 2 feet by 2 feet. Typical carpet tile has a backing to which the carpet pile or fibers are attached. A carpet tile may be attached with releasable adhesive or employ buttons on the bottom of the carpet backing to align with the holes in the access floor panel.

SUMMARY OF INVENTION

An anchor for a carpet tile includes a base in the shape of a plus sign or cross. As with a cross, the base has four arms extending from a vertex. The arms configured perpendicularly to each other to form a planar top surface and a planar bottom surface. A vertical blade, also in the shape of a cross, is centered on the base and rises to a height sufficient to engage the backing of a carpet tile when a corner of the carpet tile is placed near the vertex. The blade is preferably made of bendable and resilient material, such as nylon. Preferably, the anchor is used with a pedestal head or a stringer of a raised-flooring system and has a nub extending from the bottom surface of each of the arms of the base to fit within holes in the pedestal head or stringer and thereby secure the anchor to the pedestal head or stringer. An alternative anchor includes a plate for the base and the blade in the shape of a cross rises from the plate. The plate may have a hole in each quadrant defined by the blade.

Technical Problem

Carpet tiles can creep or move out of alignment during installation and when heavy loads such as office furniture or equipment are rolled over the tiles, giving an unsightly appearance and raising maintenance and replacement costs. A device is needed to help the installer keep a carpet tile in alignment with its access floor panel and to anchor the carpet tile without creating misalignment in the access flooring or creating a noticeable depression or protrusion in the carpet tile.

Solution to Problem

An anchor in the shape of a thin, flat cross with equally thin vertical blades. The anchor is configured to be easily attachable to the pedestal head or stringer to hold the backing of a carpet tile in alignment with its access floor panel and will prevent lateral movement of the carpet tile in heavy-load transit conditions.

Alternatively, an anchor may hold just the carpet tile in an installation directly to a substrate, e.g., a concrete slab or plywood underlayment, without an access floor system.

Advantageous Effects of Invention

The anchor will maintain carpet tiles in alignment with an access floor panel or simply in alignment with other carpet tiles on substrates, ramps or inclines. This will maintain the quality of the carpet tile installation, eliminate costly maintenance associated with displaced or misaligned carpet tiles; and will perform out of sight and feel of people walking on installed carpet tiles.

BRIEF DESCRIPTION OF DRAWINGS

The drawings illustrate preferred embodiments of the method of the invention and the reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention. For example, the steps in the method of the invention may be performed in any order that results making or using the anchor.

Figure 1:
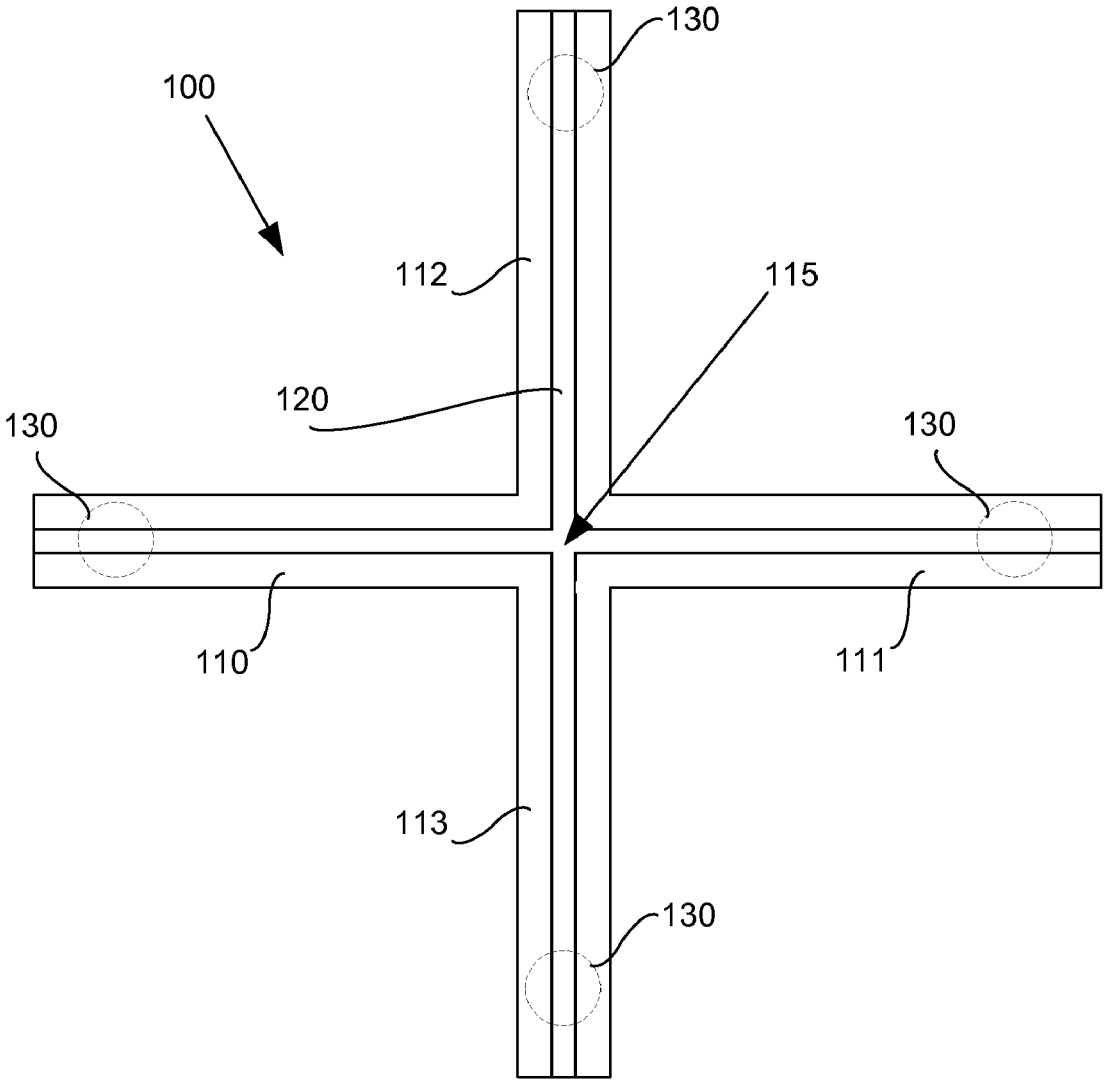
FIG. 1 is a plan view of a first anchor embodiment.

FIG. 1 shows a plan view of a preferred embodiment of the anchor (100). This anchor (100) is used with a carpet tile, typically 24 inches square and having four corners. Carpet tiles typically are constructed with a backing and fibers attached to the backing.

The anchor (100) includes a base in the shape of a cross, or a plus sign, that is, a base comprising four arms extending from a vertex (115). The base is preferably a smooth, flat, relatively thin, rigid, yet bendable and resilient body of uniform thickness; yet, the material must be firm enough to prevent the carpet tile from moving out of alignment with the access floor panel. It is preferably made of nylon and more preferably recycled nylon.

Figure 2:
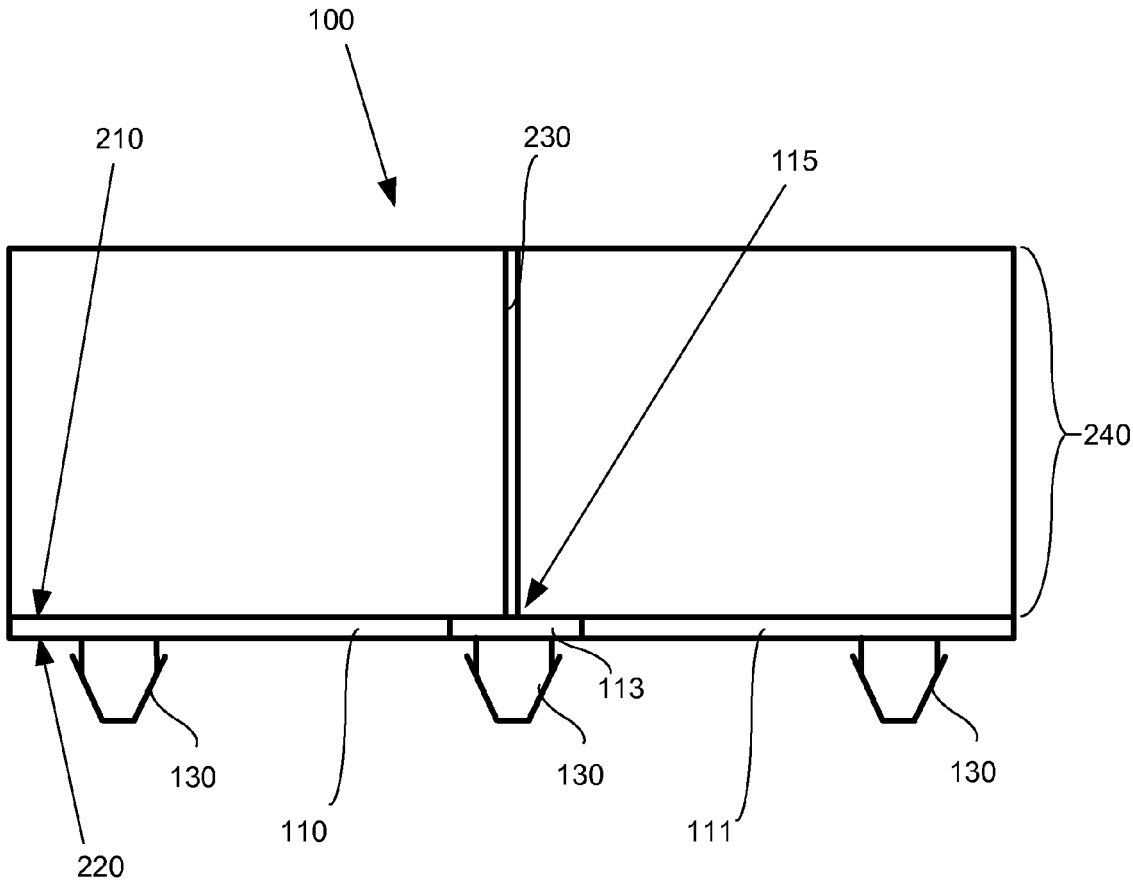
FIG. 2 is an elevation view of the first anchor embodiment.

The four arms shown are: a left arm (110); a right arm (111); a top arm (112); and a bottom arm (113). The arms come together at the vertex (115). The arms are configured perpendicularly to each other to form a planar top surface (210) and a planar bottom surface (220), as shown in the elevation view in FIG. 2

The anchor (110) further includes a blade (120) in the shape of a cross, oriented vertically, and rising from the base to a height sufficient to engage the backing of the carpet tile when a corner of the carpet tile is placed near the vertex (115). The blade (120) engages the backing of the carpet tile in use when it protrudes above the top of the access floor panel just enough to engage the thickness of the carpet tile backing, which allows carpet tile to be aligned with the access floor panel.

The blade (120), like the base is preferably a smooth, flat, relatively thin, rigid, yet bendable and resilient body of uniform thickness, preferably about half the thickness of the base. It is also preferably made of nylon and molded together with the base as a single piece.

The anchor (110) may include a nub (130) extending from each of the arms on the planar bottom surface (220). Since there are four arms, this means that there are preferentially four nubs (130). Each nub (130) preferably is tapered and has upwardly slanting barbs to engage and lock within a hole in the pedestal head or stringer in a raised flooring system. Thus, the nubs (130) are useful in securing the anchor (110) to a raised-flooring system support because they are configured to fit within holes in the pedestal head or stringer. A pedestal head usually has 4 such holes.

The anchor (100) is preferably used to anchor and align a carpet tile in a raised flooring system comprising an access floor panel and a raised flooring system support that includes either pedestal head or stringer.

The method involving such use includes a first step of securing the base to the pedestal head or stringer of the raised flooring system support by inserting the each nub into a hole in the raised flooring system support, that is, into the pedestal head or stringer. The nubs would lock in place and hold the anchor (100) firmly resisting movement.

Then, one would implement a second step of placing an access floor panel near the vertex (115). The access floor panel can be installed free standing using a stringer system, or may be screwed in place on the pedestal head and the anchor (100) will not interfere with either installation operation.

Once the access floor panel is laid in place as a free-standing install in a stringer system, or is secured at four corners, and typically all adjacent access floor panels would be similarly installed, then one would implement the step of placing the carpet tile atop the access floor panel to engage the blade (230) against the backing of the carpet tile. The carpet tile would fit right up against the bit of blade (230) sticking above the access floor panel with just enough height to engage the backing of the carpet tile, but preferably not extend up into the pile or fibers of the carpet tile, so as to be virtually undetectable to a person walking on the carpet tile.

Example 1

A preferred embodiment of the anchor (100) is one having dimensions where the distance from the end of the left arm (110) to the end of the right arm (111) is 82.55 millimeters (3.25 inches), which is equal to the distance from the end of the top arm (112) to the end of the bottom arm (113). Each arm is about 6.35 millimeters (0.25 inches) wide. The distance between the two nubs (130) on the vertical or the horizontal arms shown in FIG. 1 is about 63.50 millimeters (2.5 inches), wherein each nub (130) is about 31.75 millimeters from the vertex (115). The thickness of each arm in the base is about 1.57 millimeters (1/16 inch). The thickness of the blade 0.812 millimeters (1/32 inch). The height (240) of the blade will vary depending on the thickness of the access plate used and the thickness of the backing of the carpet tile. A typical height (240) will be about 32.46 millimeters (1.278 inches). Each nub (130) is about 5.05 millimeters (0.199 inches).

Figure 3:
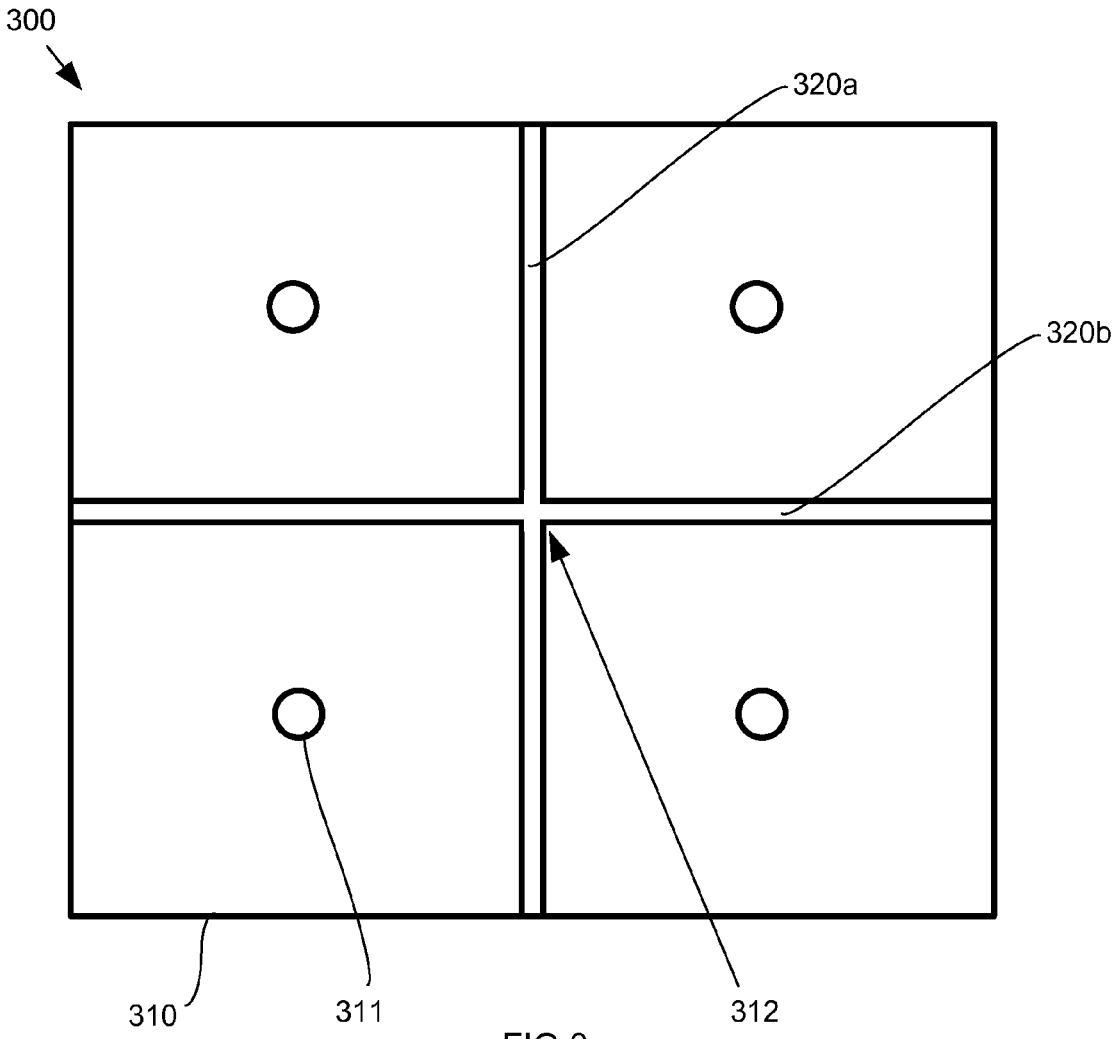
FIG. 3 is a plan view of a second anchor embodiment.
Figure 4:
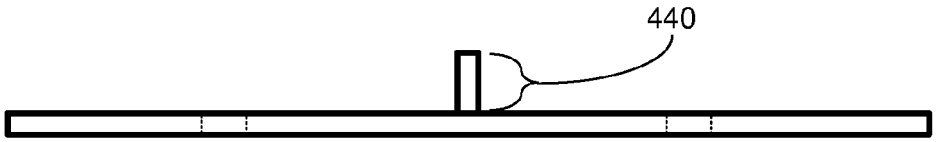
FIG. 4 is an elevation view of the second anchor embodiment.

FIG. 3 illustrates an alternative embodiment of an anchor (300) according to the invention, which also has application to a flat flooring surface, that is, an application to either a pedestal head or to a floor without a pedestal head.

This anchor (300) first includes a plate (310), which is preferably a smooth, flat, relatively thin, rigid, yet bendable and resilient body of uniform thickness. The plate (310) is preferably in a square configuration and may be configured to define a hole (311) in a quadrant defined by the segments of the blade (230). Each hole in the plate (310) preferably aligns with the corner screws of the access floor panel. Each hole in the plate (310) may also be used for attachment to substrate surfaces. A releasable adhesive is preferably used to attach the plate to either a floor or a pedestal head.

This anchor (300) next includes a blade in the shape of a cross or a plus sign. The blade includes two transverse segments: a first transverse segment (320*a*); and, a second transverse segment (320*b*). The two transverse segments form a vertex (312) at their intersection. The two transverse segments are configured perpendicularly to each other. Together the two transverse segments rise vertically from the plate (310) to a height (440) sufficient to engage the backing of the carpet tile when a corner of the carpet tile is placed near the vertex (312). The first transverse segment (320*a*) and the second transverse segment (320*b*) are each preferably a smooth, flat, relatively thin, rigid, yet bendable and resilient body of uniform thickness, preferably made of nylon and molded in one piece with the plate (310).

Example 2

A preferred embodiment of the anchor (300) for use where only the carpet tile sits above the plate (310) is one where the thickness of the square plate (310) is about 0.25 to 0.5 millimeters (0.01 to 0.02 inches) and the blade rises to a height (440) of about 2 millimeters (0.08 inches).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the building and flooring industries.

What is claimed is:

1. An anchor system comprising a combination of a carpet tile, the carpet tile comprising four corners, a backing and fibers attached to the backing, the combination further comprising an anchor, the anchor comprising:

a base in the shape of a cross, the base comprising four arms extending from a vertex, the arms configured perpendicularly to each other to form a planar top surface and a planar bottom surface; and a blade comprising a top edge in the shape of a cross, said blade rising from the base to a height with the top edge engaging the backing of the carpet tile when a corner of the carpet tile is placed near the vertex.

2. The anchor system of claim 1, wherein the blade comprises a bendable and resilient material.

3. The anchor system of claim 1, wherein the blade consists of nylon.

4. The anchor system of claim 1, the combination further comprising a pedestal head, the pedestal head defining a hole, the anchor further comprising a nub, the nub comprising a round cross-section extending from each of the arms on the planar bottom surface; wherein each such nub is configured to fit within a hole in the pedestal head and thereby secure the anchor to the pedestal head.

5. An anchor system comprising a combination offer a carpet tile, the carpet tile comprising four corners, a backing and fibers attached to the backing, the combination further comprising an anchor, the anchor comprising: a plate; and a blade comprising a top edge in the shape of a cross, the blade comprising two transverse segments forming a vertex at their intersection, the transverse segments configured perpendicularly to each other and rising vertically from the plate to a height with the top edge engaging the backing of the carpet tile when a corner of the carpet tile is placed near the vertex.

6. The anchor system of claim 5, wherein the plate defines a hole in a quadrant defined by the segments of the blade.

7. A method of anchoring the carpet tile of claim 4 to an access floor panel comprising the steps of:

securing the base to the pedestal head by inserting the each nub into the hole;

placing an access floor panel near the vertex; and placing the carpet tile atop the access floor panel to engage the blade against the backing.

8. A method of using the anchor system of claim 1 with raised flooring, the method comprising the step of:

attaching the anchor to a structure selected from the group consisting of a pedestal head, and a stringer, said attaching performed such that the anchor:

holds the backing of the carpet tile in alignment with its access floor panel; and prevents lateral movement of the carpet tile under load transit conditions.

9. A method of using the anchor system of claim 1 with raised flooring, the method comprising the step of maintaining a plurality of carpet tiles in alignment on a substrate.

* * * * *